US008867319B2

(12) United States Patent
Keith

(10) Patent No.: US 8,867,319 B2
(45) Date of Patent: Oct. 21, 2014

(54) INTERVAL TIMING DEVICE

(76) Inventor: Cody Keith, Fowler, KS (US)

( * ) Notice: Subject to any disclaimer, the term of this patent is extended or adjusted under 35 U.S.C. 154(b) by 473 days.

(21) Appl. No.: 13/246,913

(22) Filed: Sep. 28, 2011

(65) Prior Publication Data

US 2012/0075959 A1 Mar. 29, 2012

Related U.S. Application Data

(60) Provisional application No. 61/387,589, filed on Sep. 29, 2010.

(51) Int. Cl.
*G04F 3/08* (2006.01)

(52) U.S. Cl.
CPC ..... *G04F 3/08* (2013.01)
USPC ..... 368/108; 368/89; 368/109

(58) Field of Classification Search
CPC ..... G04F 1/00
USPC ..... 368/89, 108
See application file for complete search history.

(56) References Cited

U.S. PATENT DOCUMENTS

| | | | | | |
|---|---|---|---|---|---|
| 4,337,529 | A * | 6/1982 | Morokawa | 377/20 |
| 4,525,074 | A * | 6/1985 | Murakami | 368/10 |
| 4,632,570 | A * | 12/1986 | Kelsey | 368/107 |
| 4,832,332 | A * | 5/1989 | Dumbser | 482/8 |
| 5,033,013 | A * | 7/1991 | Kato et al. | 702/160 |
| 6,042,549 | A * | 3/2000 | Amano et al. | 600/500 |
| 6,358,188 | B1 * | 3/2002 | Ben-Yehuda et al. | 482/8 |
| 6,796,925 | B2 * | 9/2004 | Martinez et al. | 482/8 |
| 7,502,281 | B2 * | 3/2009 | Rund | 368/82 |
| 8,553,502 | B2 * | 10/2013 | Lazaridis et al. | 368/109 |
| 2003/0206496 | A1 * | 11/2003 | Neilly | 368/108 |

* cited by examiner

*Primary Examiner* — Amy Cohen Johnson
*Assistant Examiner* — Jason Collins
(74) *Attorney, Agent, or Firm* — Jon Fallon, Esq.; Michael P. Kochka, Esq.

(57) ABSTRACT

Embodiments of the present invention generally relate to an interval timing device and methods of utilizing the same. More specifically, embodiments of the present invention relate to a device for timing customized interval exercises, having set workout periods and rest periods, over a predetermined number of intervals and methods of utilizing the same. In accordance with one embodiment of the present invention, an interval timing device comprises a housing, a means for starting the interval timing device, at least one graphical user interface for displaying multimedia content, wherein the at least one graphical user interface comprises an exercise hold timer, a rest timer, and a repetition counter.

10 Claims, 3 Drawing Sheets

INTERVAL TIMING DEVICE

CROSS-REFERENCE TO RELATED APPLICATIONS

The present application is related to U.S. Provisional Application No. 61/387,589, entitled "Interval Timing Device," filed Sep. 29, 2010, the disclosure of which is incorporated by reference in its entirety.

BACKGROUND OF THE INVENTION

1. Field of the Invention

Embodiments of the present invention generally relate to an interval timing device and methods of utilizing the same. More specifically, embodiments of the present invention relate to a device for timing customized interval exercises, having set workout periods and rest periods, over a predetermined number of intervals and methods of utilizing the same.

2. Description of the Related Art

Physical conditioning and strength training can be enhanced when exercises are performed while alternating a strenuous pace for a short period of time and then resting for a short period of time. The workout can be even further enhanced by repeating such sets of exercise and rest periods throughout a workout. Such periodic repetition of such activity is generally called interval training.

Athletes of all forms, from highly toned professionals to those just getting in shape, have proven that interval training yields enhanced results. In addition to athletes, anyone trying to increase their muscle mass or physical performance, due to physical injury, or even for general activities such as typing on a computer keyboard or playing a musical instrument, can benefit from interval training.

Generally, to minimize the risk of injury, a workout may begin slowly, and the individual may gradually increase the intensity of the workout after the muscles have been warmed up. Thereafter, exercise may be carried out at a more strenuous level until the muscles being exercised are sufficiently tired. Throughout the entire exercise, however, periods of activity and rest must be tracked and monitored so as to ensure the individual is maximizing his or her benefit from the workout.

Where a personal trainer or physical therapist is involved in assisting the individual to exercise, the trainer or therapist may be able to watch a clock or timer and tell the individual exactly what to do, e.g., how many counts, how much rest, etc. However, if the individual is on his or her own for the workout, or if the trainer or therapist is trying to assist multiple individuals at once, trying to track such performance can become very difficult to track.

Currently, a trainer, therapist or the athlete his/herself uses a stopwatch or an ordinary clock to time individual periods of exercise and periods of rest in running an interval training program. While some more advanced watches or timers are capable of providing generic signals for tracking pace, time, etc. (e.g., an audible signal to indicate the pace which a runner must run to cover a certain distance in a certain amount of time), no device exists that is capable of providing the details of an interval training workout.

Thus, there is a need for an interval timing device and methods of utilizing the same.

SUMMARY

Embodiments of the present invention generally relate to an interval timing device and methods of utilizing the same. More specifically, embodiments of the present invention relate to a device for timing customized interval exercises, having set workout periods and rest periods, over a predetermined number of intervals and methods of utilizing the same.

In accordance with one embodiment of the present invention, an interval timing device comprises a housing, a means for starting the interval timing device, at least one graphical user interface for displaying multimedia content, wherein the at least one graphical user interface comprises an exercise hold timer, a rest timer, and a repetition counter.

In another embodiment of the present invention, a method of interval training utilizing an interval timing device comprises: providing an interval timing device comprising: a housing; a means for starting the interval timing device; and at least one graphical user interface for displaying multimedia content, wherein the at least one graphical user interface comprises an exercise hold timer, a rest timer, and a repetition counter; setting the exercise hold timer, the rest timer and the repetition counter to predetermined values; engaging the means for starting the interval timing device; conducting an exercise routine in accordance with the exercise hold timer; resting in accordance with the rest timer, upon commencement of the rest timer; and re-conducting an exercise routine upon indication by the repetition counter, and recommencement of the exercise hold timer.

In yet another embodiment of the present invention, a computer readable medium comprising a computer program having executable code, the computer program for enabling an interval timing device, the computer program comprising instructions for: creating a virtual interval timing device on a graphical user interface of a computer, the virtual interval timing device having visual representations of a means for starting the interval timing device, an exercise hold timer, a rest timer, and a repetition counter; enabling a user to set the exercise hold timer, the rest timer and the repetition counter to predetermined values; enabling a user to start the interval timing device; operating the exercise hold timer while an exercise routine is conducted; operating the rest timer, upon completion of the exercise routine; adjusting the repetition counter by one unit upon completing of the rest timer; and resetting and re-operating the exercise hold timer while the exercise routine is re-conducted.

BRIEF DESCRIPTION OF THE DRAWINGS

So the manner in which the above recited features of the present invention can be understood in detail, a more particular description of embodiments of the present invention, briefly summarized above, may be had by reference to embodiments, several of which are illustrated in the appended drawings. It is to be noted, however, the appended drawings illustrate only typical embodiments of embodiments encompassed within the scope of the present invention, and, therefore, are not to be considered limiting, for the present invention may admit to other equally effective embodiments, wherein.

Figure 1:
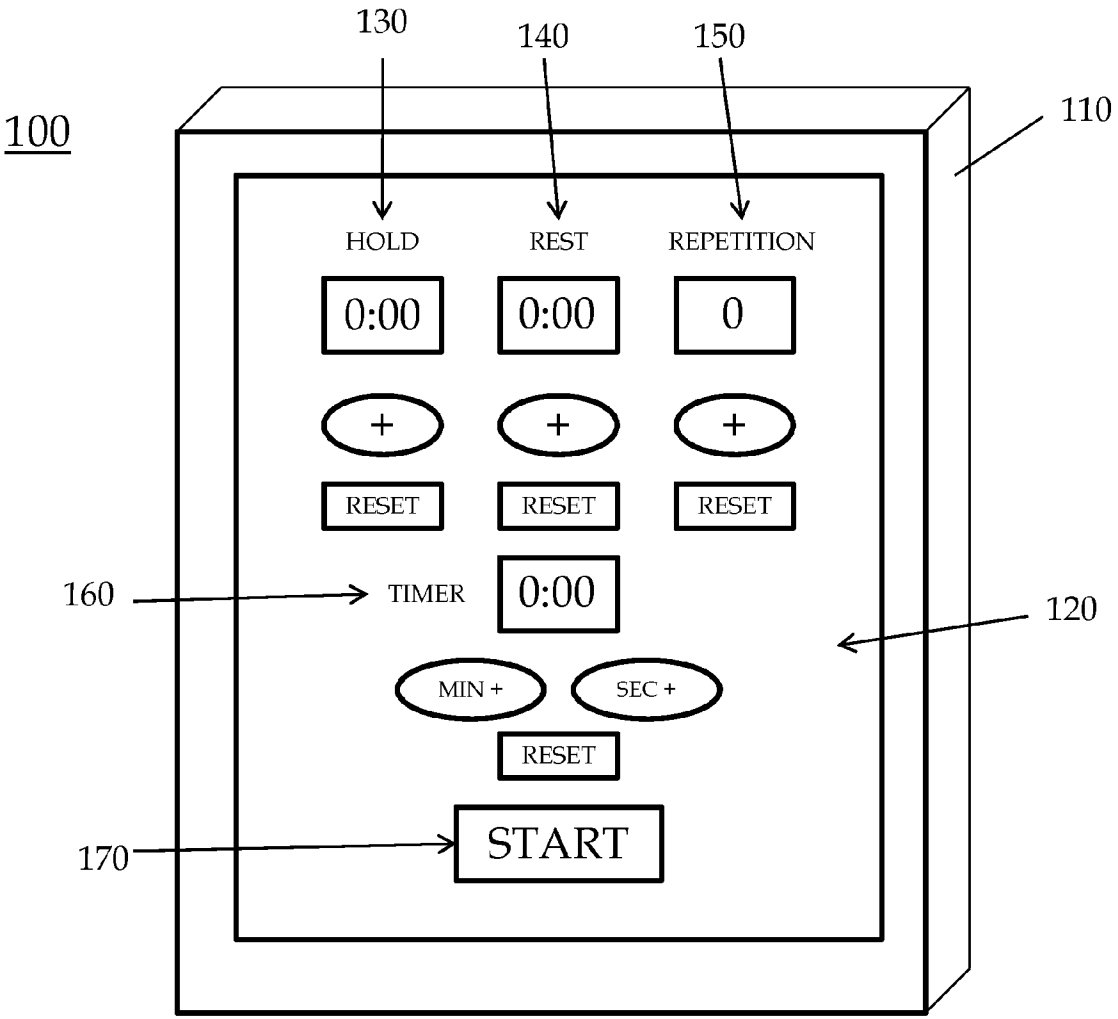
FIG. 1 depicts an interval timing device in accordance with one embodiment of the present invention.

The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean including but not limited to. To facilitate understanding, like reference numerals have been used, where possible, to designate like elements common to the figures.

DETAILED DESCRIPTION

Embodiments of the present invention generally relate to an interval timing device and methods of utilizing the same. More specifically, embodiments of the present invention relate to a device for timing customized interval exercises, having set workout periods and rest periods, over a predetermined number of intervals and methods of utilizing the same.

FIG. 1 depicts an interval timing device in accordance with one embodiment of the present invention. In accordance with embodiments of the present invention, an interval timing device 100 comprises a housing 110 and a graphical user interface 120 for interacting with the user. In many embodiments, the housing 110 may be in the form of a computer (e.g., a personal computer, a mobile computer, a laptop, a netbook, or the like), a handheld electronic device (e.g., a portable device (similar to a traditional stopwatch), a mobile smartphone, or the like). Accordingly, although not depicted in the Figure, normal operating components of computers, electronic devices, etc., including, for example, power supply, a processor, a memory for storing instructions regarding the operation of the device, I/O components for creating the audio and visual effects disclosed herein and for receiving instructions from the user, etc., may all be included within the housing 110. Whereas such basic components would be readily known to one of ordinary skill in the art, no further description thereof is necessary; however, such components are fully described and shown as the general computer device in United States Patent Application Publication No. 2011/0161420, the disclosure of which is incorporated herein by reference in its entirety.

Generally, an interval timing device 100 further comprises at least one exercise hold timer/counter 130, a rest timer 140, a repetition counter 150 and a start button 170 that may also be utilized as a "pause/stop" button during the course of a workout. In many embodiments, the interval timing device 100 additionally comprises a general timer 160, which may time an entire interval or repetition workout routine. As shown in the Figure, each of the timers or counters may also be provided with an adjustment key to increase or decrease a pre-set value of the timer or counter. Similarly, each of the timers or counters may be provided with a reset button, which may be utilized to reset the timer or counter when a workout routine is completed or prematurely stopped.

Each of the timers or counters may comprise a visual readout, for example, an LED screen for displaying the relevant information. Other types of displays may also be utilized, including any type of known audio and/or visual display.

In accordance with embodiments of the present invention, although shown as a touch screen device having interactive "buttons" thereon, certain embodiments of the present invention may require tangible switches/buttons on the exterior of the housing. As such, the exemplary embodiments of the present invention as shown herein, should be understood to encompass the disclosed functionality within less advanced technological mediums.

The exercise hold timer/counter 130 may generally be utilized to time or count a user engaged in a particular exercise. When utilized as a timer, the exercise hold timer/counter 130 can be set utilizing an adjustment key to a particular amount of time for which the user is seeking to be engaged in a specific exercise (e.g., running on a treadmill). The exercise hold timer/counter 130 can be set to any interval of time, e.g., seconds, minutes, hours, etc.

When the exercise hold timer/counter 130 is utilized as a counter, the adjustment key may be utilized to set to a particular numerical count of a specific exercise (e.g., for twenty pushups). When utilized as a counter, the exercise hold timer/counter 130 may be in communication with a sensor (not shown) for assisting in the "counting" or completion of an exercise. For example, in one embodiment, the exercise hold timer/counter 130 may be utilized with a visual sensor that perceives the action of a full pushup, and can notify the exercise hold timer/counter 130 upon completion of each one. In another exemplary embodiment, the exercise hold timer/counter 130 may be utilized with an audio sensor that can receive audible information from the user or a machine to notify the exercise hold timer/counter 130 upon completion. In yet another exemplary embodiment, the interval timing device may be in wired or wireless communication with one or more machines on which the user is conducting the exercises (e.g., a rowing machine). Whereas many of such machines can count completion of a motion, such information could be transmitted to the interval timing device 100, and the exercise hold timer/counter 130 could function accordingly.

The exercise hold timer/counter 130 may be capable of recording or storing numerous counts, times, or combinations thereof for a plurality of exercises within an exercise set. For example, if a trainer indicates to an individual that she should complete 10 pushups, do sit-ups for 90 seconds, and then do 5 squats within a first exercise set, the exercise hold timer/counter 130 may record such information as provided. In use, the exercise hold timer/counter 130 may count/time through each of the individual exercises within the first exercise set (i.e., go from counting to timing to counting) before resting or repetition commences.

The rest timer 140 may generally be utilized to time a rest period for a user between particular exercises. The rest timer 140 can be set utilizing an adjustment key to a particular amount of time for which the user is seeking to rest (e.g., one minute). The rest timer 140 can be set to any interval of time, e.g., seconds, minutes, hours, etc.

The repetition counter 150 may generally be utilized to count the number of sets of exercise and rest periods a user wishes to complete. In many embodiments, the repetition counter 150 may be set using an adjustment key to any possible numerical value, although for most practical embodiments, values between about 1 to about 100 are likely suitable.

The general timer 160 may be utilized to count the overall time of a workout routine, count to a specific preset time (e.g., if a user wants to keep an entire routine to an hour, the general timer 160 may count up to such time and may notify the user when the time has been reached, regardless of the status of any other timer). In alternative embodiments, the general timer 160 may be used to count down a preset amount of time. In most embodiments, the general timer 160 may be set using one or more adjustment keys, and may be set to any period of time suitable for embodiments of the present invention (e.g., seconds, minutes, hours, days, etc.).

The start button 170 generally initiates each of the timers/counters within the interval timing device 100. However, at any time during the execution of such steps, the start button 170 may be utilized to pause and/or stop the overall counting. In one particular embodiment, however, pressing the start button 170 during operation will not stop the general timer 160, as such timer is tracking the real-time of the overall workout routine.

Although not shown in the Figure, the interval timing device 100 may be provided with numerous visual and audio indicators, for example, alarms, blinking lights, etc. to notify the user of when certain time periods or counts have been reached. In view of the multitude of features in many of the embodiments of the interval timing device 100, it may be desirable to provide multiple types of audio and visual indicators to allow the user an opportunity to distinguish between each of such indications.

Figure 2:
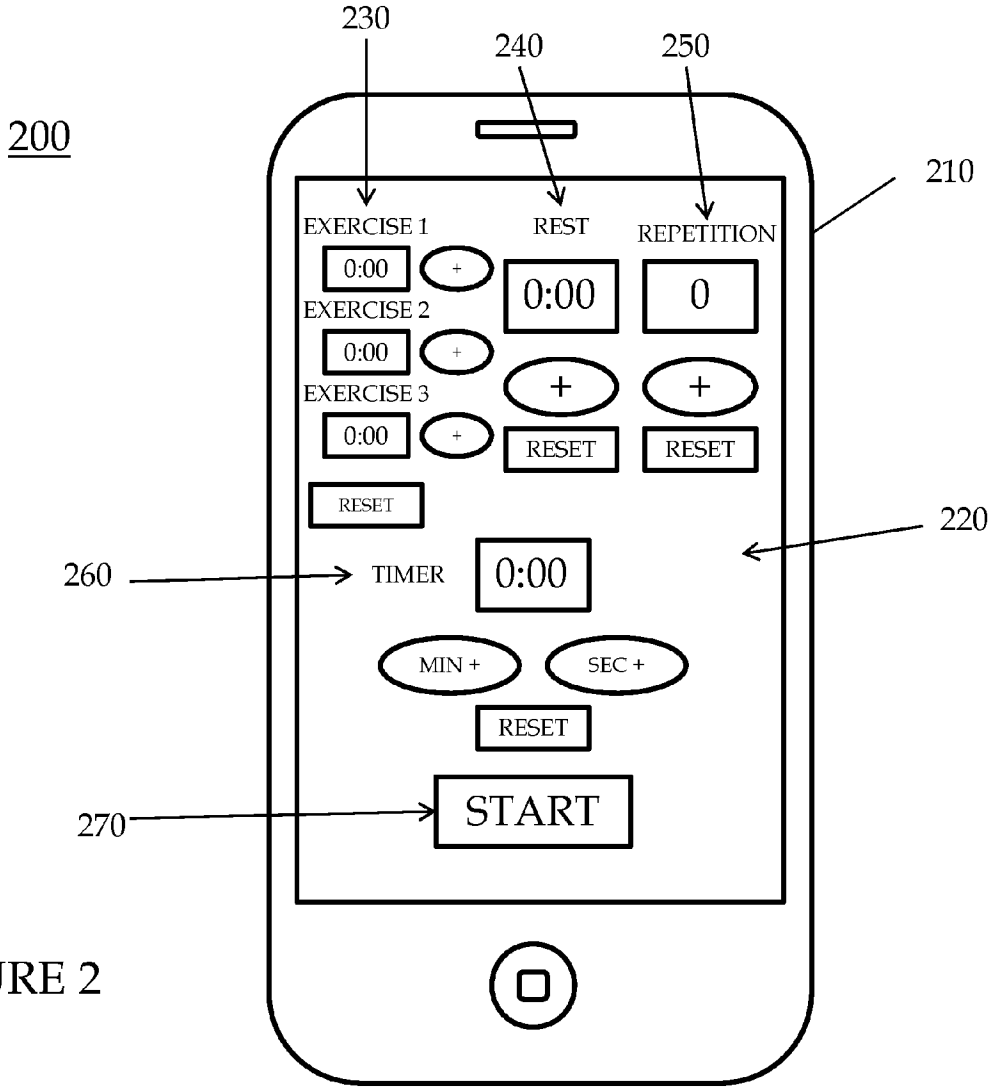
FIG. 2 depicts an interval timing device in accordance with another embodiment of the present invention.

FIG. 2 depicts an interval timing device in accordance with another embodiment of the present invention. As shown in the Figure, an alternative embodiment of the interval timing device 200 comprises executable instructions or application that may be downloaded or otherwise installed onto a mobile device 210, for example, a smartphone. Whereas the nature of such downloadable "applications" are well known in the smartphone industry, no further discussion on the nature of the downloadable instructions is deemed necessary for disclosure of such embodiments of the present invention.

In many embodiments, once executable instructions are downloaded onto a computer readable medium, the device comprising the computer readable medium becomes a virtual interval timing device as described above. For example, once the executable instructions are downloaded on a mobile communication device (e.g., an iPhone), the touchscreen of the mobile communication device provides a virtual display of all the components of the interval timing device, and the processor of the mobile communication device enables the virtual display to operate like the interval timing devices described herein.

As shown in the Figure, an interval timing device 200 generally comprises a smartphone housing 210, a user interface screen 220, a plurality of exercise hold timers/counters 230, a rest timer, a repetition counter 250 and a start button 270. Similar to the embodiments discussed supra, a general timer 260 may also be provided.

The plurality of exercise hold timers/counters 230 may each be utilized to count or time a different exercise, as is common during interval strength training. For example, a first exercise may require the user to complete twenty pushups, a second exercise may require twenty-five sit-ups, and a third exercise may require thirty seconds sprinting on a treadmill before the user can take a ninety second rest. By providing any number of exercise hold timers/counters 230, the interval timing device 200 may be adapted to any variety of interval training routines.

Between varying workout routines, there may not always be the same number of exercises per interval (i.e., there may be only one exercise during one set, and four exercises in another set). Accordingly, in certain embodiments, the plurality of exercise hold timers/counters 230 may all appear in a single visual display, and through use of other switches/buttons (not shown), a user may be able to toggle through any number of exercises the user wishes to engage in a particular session.

Each of the other functions displayed in the interval timing device 200 may operate substantially similar as those in the embodiment shown in FIG. 1. As such, no further description of such features is deemed necessary.

Figure 3:
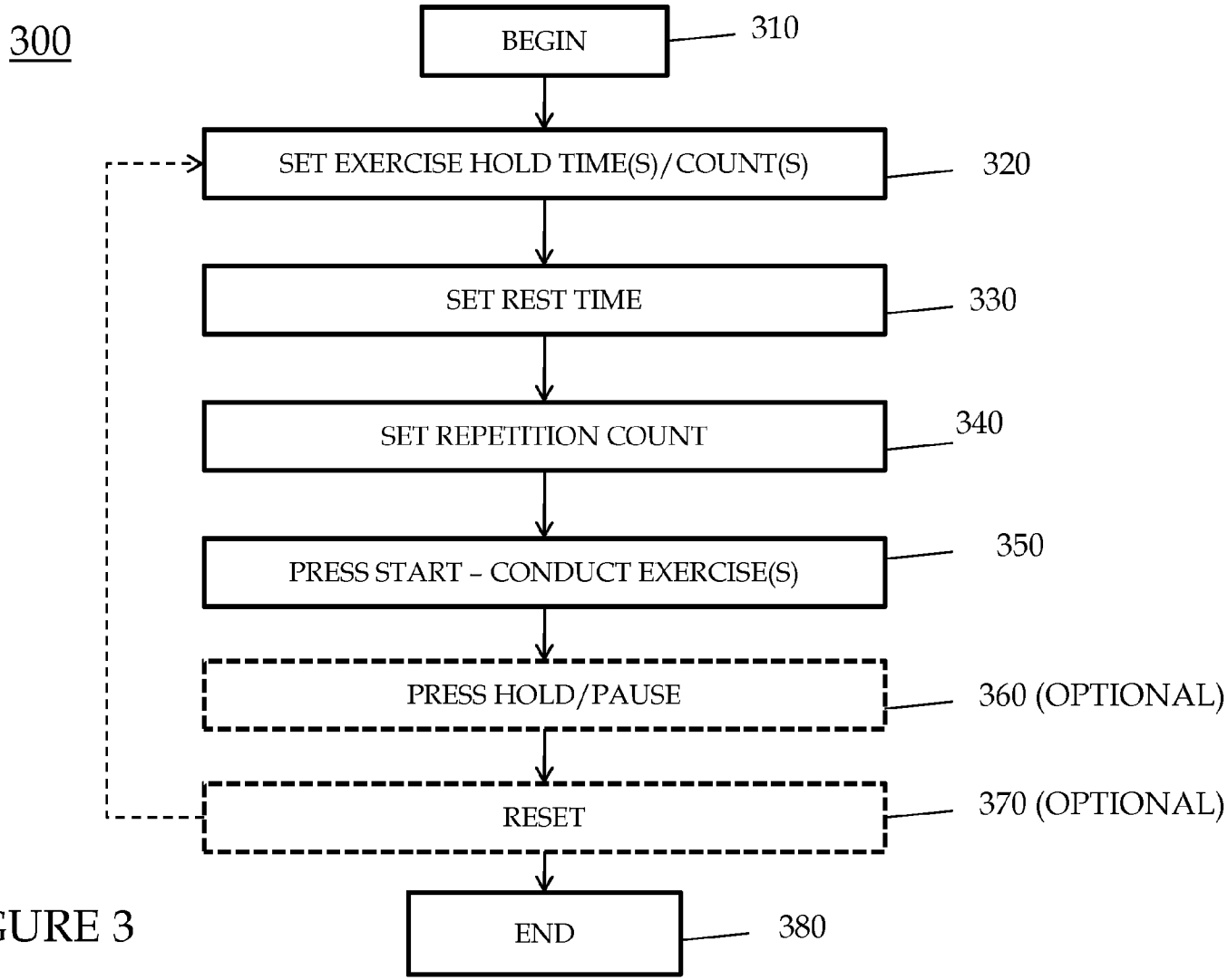
FIG. 3 depicts a flowchart of a method of utilizing the interval timing device in accordance with yet another embodiment of the present invention.

FIG. 3 depicts a flowchart of a method of utilizing the interval timing device in accordance with yet another embodiment of the present invention. The method 300 begins at step 310, whereby an interval timing device, having the features and functionality of embodiments of the present invention is provided.

At step 320, the user may set one or more exercise hold time(s) or count(s), depending on the nature of the exercise and the optional features provided with the interval timing device. At step 330, the user sets a desired rest time for pausing between the next set of exercise(s). At step 340, the user sets a repetition count for a desired amount of intervals of exercise(s) and rest periods.

At step 350, the user starts the workout routine by pressing start and beginning the first set of exercise(s). Once start is pressed, the interval timing device begins counting or timing down the first exercise(s) until the predetermined threshold is reached. Upon completion of the first exercise, the timer/counter for any subsequent exercise may begin (if available). Once the exercise(s) are complete, the rest timer will count down the predetermined rest time. Upon completion of the rest time, the repetition counter is reduced by one, and the timer/counter for the exercise(s) begins again.

Generally, once the interval timing device starts, the user need not take any other action with the device until the workout routine is complete, or a particular time threshold has been reached. At step 360, the user may optionally press hold/pause, which will generally freeze all timing and/or counting within the device. This may be desirable, for example, if the user is experiencing some type of pain or discomfort during the workout, if someone interrupts the workout, etc. Once the device has been paused, held or stopped, it may generally be restarted by pressing the start button again.

Once the workout routine is complete, or after the device has been paused by the user, the device may optionally be reset at step 370. In order to reset the device, each of the reset buttons described supra may be engaged, or the device may be provided with a global reset button. If the user elects to conduct the workout routine again, upon pressing the reset button(s), the method 300 returns to step 320, and the steps continue.

If the user does not wish to redo the workout routine, or if the a predetermined general time has elapsed, or for any other reason, at step 380, the method may end.

While the foregoing is directed to embodiments of the present invention, other and further embodiments of the invention may be devised without departing from the basic scope thereof. It is understood that various embodiments described herein may be utilized in combination with any other embodiment described, without departing from the scope contained herein.

What is claimed is:

1. A standalone interval timing device consisting of:

a housing;

a power source;

a means for starting the interval timing device;

an exercise hold timer;

a rest timer;

a repetition counter;

a general timer for timing an entire interval workout routine, wherein the general timer counts up or down to a selected time, wherein the general timer is displayed in a coherent display with the hold timer, the rest timer, and the repetition counter and all timers and counters are displayed simultaneously;

a plurality of reset buttons, each reset button associated with one of the exercise hold timer, the rest timer, the repetition counter, and the general timer, respectively, wherein the value displayed on each of the exercise hold timer, rest timer, and repetition counter is restored to zero upon depression of each of the reset buttons, respectively;

at least one visual/audio indicator for notifying the user when selected time periods or counts have been reached by any of the timers during an exercise;

wherein the exercise hold timer, the rest timer, and the repetition counter stop when the general timer reaches the selected time; and wherein the standalone interval timing device operates independently of any other device.

2. The interval timing device of claim 1, wherein the means for starting the interval timing device comprises a start button.

3. The interval timing device of claim 2, wherein the start button provides instructions to either start the interval timing device when in an off position, or to pause the interval timing device when in a timing position.

4. The interval timing device of claim 1, wherein each of the exercise hold timer, rest timer, and repetition counter comprises an adjustment key to increase or decrease a pre-set value.

5. The interval timing device of claim 1, wherein the at least one visual/audio indicator comprises one of an LED screen, an alarm, a blinking light, or combinations thereof.

6. A method of interval training utilizing an interval timing device comprising:

providing an interval timing device consisting of:

a housing;

a power source;

a means for starting the interval timing device;

an exercise hold timer;

a rest timer;

a repetition counter;

a general timer for timing an entire interval workout routine, wherein the general timer counts up or down to a selected time, wherein the general timer is displayed in a coherent display with the hold timer, the rest timer, and the repetition counter and all timers and counters are displayed simultaneously;

a plurality of reset buttons, each reset button associated with one of the exercise hold timer, the rest timer, the repetition counter, and the general timer, respectively, wherein the value displayed on each of the exercise hold timer, rest timer, and repetition counter is restored to zero upon depression of each of the reset buttons, respectively;

at least one visual/audio indicator for notifying the user when selected time periods or counts have been reached by any of the timers during an exercise;

wherein the exercise hold timer, the rest timer, and the repetition counter stop when the general timer reaches the selected time; and wherein the standalone interval timing device operates independently of any other device setting the exercise hold timer, the rest timer, the general timer, and the repetition counter to predetermined values;

engaging the means for starting the interval timing device;

conducting an exercise routine in accordance with the exercise hold timer;

resting in accordance with the rest timer, upon commencement of the rest timer; and re-conducting an exercise routine upon indication by the repetition counter, and recommencement of the exercise hold timer.

7. The method of claim 6, wherein the exercise routine comprises a plurality of individual exercises, each of the plurality of individual exercises having its own time interval or count interval; and wherein conducting an exercise routine in accordance with the exercise hold timer comprises completion of each of the plurality of individual exercises.

8. The method of claim 6, wherein the means for starting the interval timing device comprises a start button that provides instructions to either start the interval timing device when in an off position, or to pause the interval timing device when in a timing position.

9. The method of claim 6, wherein setting the exercise hold timer, the rest timer and the repetition counter to predetermined values comprises pressing an adjustment key to increase or decrease each timer or counter to the predetermined value.

10. The method of claim 9, wherein setting the exercise hold timer, the rest timer, the general timer, and the repetition counter to a predetermined value comprises pressing a reset button for each timer or counter, where the predetermined value is zero.

* * * * *